US012398554B2

(12) United States Patent
Wang et al.

(10) Patent No.: US 12,398,554 B2
(45) Date of Patent: Aug. 26, 2025

(54) SPACE CURVED RETICULATED SHELL STRUCTURE FORMED BY STACKING AND COMBINING RHOMBIC DODECAHEDRONS AND A CONSTRUCTION METHOD THEREOF

(71) Applicant: Zhejiang University City College, Zhejiang (CN)

(72) Inventors: Zhen Wang, Zhejiang (CN); Yang Zhao, Zhejiang (CN); Zhi Ding, Zhejiang (CN); Chongan Pang, Zhejiang (CN); Ruhao Wang, Zhejiang (CN); Haochuan Qu, Zhejiang (CN)

(73) Assignees: Zhejiang University City College, Hangzhou (CN); Zhejiang Province Institute of Architectural Design and Research, Hangzhou (CN)

( * ) Notice: Subject to any disclaimer, the term of this patent is extended or adjusted under 35 U.S.C. 154(b) by 0 days.

(21) Appl. No.: 18/008,532

(22) PCT Filed: Sep. 29, 2022

(86) PCT No.: PCT/CN2022/122520

§ 371 (c)(1),
(2) Date: Dec. 6, 2022

(87) PCT Pub. No.: WO2023/061234

PCT Pub. Date: Apr. 20, 2023

(65) Prior Publication Data

US 2024/0229445 A1 Jul. 11, 2024

(30) Foreign Application Priority Data

Oct. 14, 2021 (CN) ..... 202111197120.1

(51) Int. Cl.
*E04B 1/32* (2006.01)

(52) U.S. Cl.
CPC ..... *E04B 1/3211* (2013.01); *E04B 2001/3241* (2013.01); *E04B 2001/3294* (2013.01)

(58) Field of Classification Search
CPC . E04B 1/19; E04B 1/3211; E04B 1/32; E04B 1/3205; E04B 2001/3241;
(Continued)

(56) References Cited

U.S. PATENT DOCUMENTS 3,685,221 A * 8/1972 Mangan ..... E04B 1/34 52/80.1
3,696,566 A * 10/1972 Langner ..... E04B 1/3211 D25/13

(Continued)

FOREIGN PATENT DOCUMENTS

DE 2809503 A * 9/1979 ..... A01G 9/16
DE 3306051 A * 8/1984 ..... A63H 33/04

(Continued)

*Primary Examiner* — Kyle J. Walraed-Sullivan

(57) ABSTRACT

The invention relates to a space curved reticulated shell structure formed by stacking and combining rhombic dodecahedrons, comprising a one-way curved reticulated shell structure, a positive curvature two-way curved reticulated shell structure and a negative curvature two-way curved reticulated shell structure, the array combined revolution body is generated by rotating the orthogonal array combination body around the space rotation axis by a certain angle; boundary cutting structures are generated by the plane boundary in span direction or the curved boundary in span direction cutting the array combined revolution body; the plane boundary cutting structure respectively generates a one-way curved reticulated shell structure, a positive curvature two-way curved reticulated shell structure and a negative curvature two-way curved reticulated shell structure respectively through one-way bending arching, positive curvature two-way bending arching and negative curvature two-way bending arching.

5 Claims, 8 Drawing Sheets

(58) Field of Classification Search
CPC ..... E04B 2001/3294; E04B 2001/1975; E04B 2001/1978; E04B 2001/1981; E04B 2001/3233; E04B 2001/3235; E04B 2001/3258
See application file for complete search history.

(56) References Cited

U.S. PATENT DOCUMENTS 3,722,153 A * 3/1973 Baer ..... E04B 1/32 D25/13
3,727,356 A * 4/1973 Appenzeller ..... E04B 7/102 52/80.2
3,785,096 A * 1/1974 Neuhardt ..... E04B 1/34853 D25/4
3,970,301 A * 7/1976 Lehmann ..... E04H 15/18 428/542.6
3,977,138 A * 8/1976 Chastain ..... E04B 7/107 52/81.4
4,287,690 A * 9/1981 Berger ..... E04B 1/3211 52/81.4
4,288,960 A * 9/1981 Auras ..... E02B 3/14 52/606
4,462,191 A * 7/1984 Poirier ..... E04H 1/02 D25/4
4,665,665 A * 5/1987 Wilkinson ..... E04B 1/3211 D25/13
4,686,800 A * 8/1987 McCormick ..... E04B 1/3211 29/469
4,719,726 A * 1/1988 Bergman ..... E04B 1/3211 52/81.4
4,723,382 A * 2/1988 Lalvani ..... E04B 1/3211 D25/1
5,036,635 A * 8/1991 Lalvani ..... E04B 1/1906 52/80.1
5,155,951 A * 10/1992 Lalvani ..... A63H 33/04 52/80.2
5,197,254 A * 3/1993 Smith ..... E04B 1/3205 428/11
5,448,868 A * 9/1995 Lalvani ..... E04B 1/1903 52/648.1
5,505,035 A * 4/1996 Lalvani ..... B64G 99/00 52/311.2
5,524,396 A * 6/1996 Lalvani ..... E04B 1/19 52/311.2
5,540,013 A * 7/1996 Diamond ..... G09B 23/04 52/80.1
5,603,188 A * 2/1997 Robbin ..... E04B 7/105 52/81.1
5,615,528 A * 4/1997 Owens ..... F16S 5/00 52/576
5,623,790 A * 4/1997 Lalvani ..... A63H 33/04 52/81.2
5,628,154 A * 5/1997 Gavette ..... E04B 1/3211 403/375
6,070,373 A * 6/2000 Diamond ..... E04B 1/19 52/81.3
6,173,538 B1 * 1/2001 Fleishman ..... E04B 1/34815 52/81.3
6,282,849 B1 * 9/2001 Tuczek ..... E04B 1/32 52/648.1
6,295,785 B1 * 10/2001 Herrmann ..... E04B 1/3211 52/81.3
6,412,232 B1 * 7/2002 Provitola ..... E04B 1/32 52/80.1
6,418,673 B1 * 7/2002 Flowerday ..... E04B 1/3211 52/81.1
6,457,282 B1 * 10/2002 O'Toole ..... E04B 1/3211 52/81.3
2002/0166294 A1 * 11/2002 Rogers ..... E04B 7/102 52/81.4
2006/0160446 A1 * 7/2006 Lanahan ..... E04B 1/19 442/59
2007/0120348 A1 * 5/2007 Semiz ..... E04B 1/34 280/736
2007/0163185 A1 * 7/2007 Morley ..... E04B 1/3205 52/81.1
2007/0251161 A1 * 11/2007 Tuczek ..... E04B 7/102 52/80.1
2008/0040984 A1 * 2/2008 Lanahan ..... E02B 3/129 52/80.1
2008/0244992 A1 * 10/2008 Regan ..... E04B 1/3211 52/741.1
2008/0307720 A1 * 12/2008 Howe ..... E04B 1/3211 52/81.3
2009/0071081 A1 * 3/2009 Regan ..... E04H 15/18 52/80.2
2009/0239712 A1 * 9/2009 Van Raalte ..... A63B 69/0048 482/37
2009/0263615 A1 * 10/2009 Lanahan ..... E04B 1/34 428/80
2012/0204496 A1 * 8/2012 McSweeney ..... E04B 1/3211 52/80.1
2013/0209804 A1 * 8/2013 Gorre ..... E04B 1/3211 428/402
2015/0030790 A1 * 1/2015 Duncan, III ..... A45B 11/00 428/34.1
2015/0037766 A1 * 2/2015 Schein ..... G09B 25/04 434/211
2015/0064375 A1 * 3/2015 Kunstadt ..... B29C 61/02 29/897
2015/0283474 A1 * 10/2015 Howard ..... E04B 1/343 446/85
2015/0315775 A1 * 11/2015 Schein ..... E04B 1/3211 52/741.1
2016/0027425 A1 * 1/2016 Cook ..... F28D 7/0058 428/221
2020/0354949 A1 * 11/2020 Roberts ..... E04G 21/16
2021/0069913 A1 * 3/2021 Roberts ..... E04G 21/22
2023/0294802 A1 * 9/2023 Wan ..... B63B 73/20 52/79.1
2024/0247479 A1 * 7/2024 Nuriev ..... E04B 1/1903

FOREIGN PATENT DOCUMENTS

DE 29705064 U1 * 1/1998 ..... E04B 1/3211
FR 2414104 A * 9/1979 ..... E04B 1/1909
SU 1636539 A * 3/1991

* cited by examiner

SPACE CURVED RETICULATED SHELL STRUCTURE FORMED BY STACKING AND COMBINING RHOMBIC DODECAHEDRONS AND A CONSTRUCTION METHOD THEREOF

1. TECHNICAL FIELD

The invention relates to the technical field of structural engineering, in particular to a space curved reticulated shell structure formed by stacking and combining rhombic dodecahedrons and a construction method thereof.

2. BACKGROUND ART

The concept of stacking combination body comes from the bubble theory in physics, and the stacked and combined rhombic dodecahedron is one of the typical stacking bodies, which can fill all spaces without gaps after the three-dimensional expansion. The rhombic dodecahedron is composed of 12 identical rhombus, and contains one edge length and two types of cross-nodes, and corresponding to the two types of cross-nodes, the number of connecting rods at each node is respectively three and four, there are few connecting rods of nodes, the structure is simple.

The rhombic dodecahedron basic unit has repeatability in the directions of the three coordinate axes of the top view, the rear view and the left view, and it can be in array replication along three orthogonal directions to form the orthogonal array combination body, so as to fill the entire three-dimensional space, this type of polyhedron is a space-filling polyhedron. The space polyhedron can be cut by the building boundary to obtain the plane frame rigid structure or the curved reticulated shell structure that meets the building shape and structural rigidity.

The span of the plane rigid frame structure is easily limited by the large vertical deformation deflection, resulting in a larger thickness of the plane rigid frame. In order to improve the bearing performance, increase the structural rigidity, and increase the space span, the curved reticulated shell structure is often used in practical projects to make full use of the arc-axial compression bearing mode of the curved structure, which is an effective solution. The forms of curved reticulated shells mainly include cylindrical reticulated shells, spherical reticulated shells, dome reticulated shells and hyperboloid reticulated shells.

The edges cut out by the rhombic dodecahedron on the building cutting surface respectively form the upper and lower chord members of the roof structure, while the edges of the original rhombic dodecahedrons retained inside the cutting surface constitute the web members inside the structure. There are two effective solutions for the formation of the curved reticulated shell structure: one is to directly cut the surface of the space-filling polyhedron to form a curved reticulated shell structure; the other is to first generate a plane rigid frame structure through plane cutting, and then perform one-way or two-way bending and arching to form a curved reticulated shell structure. In the former case, the number, length and included angle of the connecting rods of nodes remain unchanged, but the grid may be messy after cutting, and there are certain restrictions on the cutting position and cutting surface; in the latter case, the length and included angle of the connecting rods of nodes change, but the grid is relatively regular; both have a certain scope of application.

Compared with the traditional space grid structure and reticulated shell structure, the space curved reticulated shell structure formed by stacking and combining rhombic dodecahedrons has the advantages of fewer connecting rods of nodes, fewer length specifications, simple node form, and better bearing stiffness, broad application prospects in the roofs and walls of large-span space structures.

In summary, it is necessary to study the form and design method of a space curved reticulated shell structure formed by stacking and combining rhombic dodecahedrons, which is suitable for the design and load bearing of large-span space curved roof and wall structure systems that require simple node structure, few rod specifications, large earthquake-resistant ductility, beautiful appearance.

3. SUMMARY OF THE INVENTION

The object of the invention is to overcome the shortcomings in the prior art and provide a space curved reticulated shell structure formed by stacking and combining rhombic dodecahedrons and a construction method thereof, so as to realize the design and load bearing of large-span space curved roof and wall structure systems, which have repeated array effect, simple node structure, large earthquake-resistant ductility, beautiful appearance.

The space curved reticulated shell structure formed by stacking and combining rhombic dodecahedrons, comprising a one-way curved reticulated shell structure, a positive curvature two-way curved reticulated shell structure and a negative curvature two-way curved reticulated shell structure; the rhombic dodecahedron is a polyhedron composed of twelve congruent rhombus; the dodecahedron basic unit is formed by the bidirectional oblique butting of four rhombic dodecahedrons along the plane; the orthogonal array combination body is formed by the dodecahedron basic unit in array replication along three orthogonal directions; the array combined revolution body is generated by rotating the orthogonal array combination body around the space rotation axis by a certain angle; boundary cutting structures are generated by the plane boundary in span direction or the curved boundary in span direction cutting the array combined revolution body, comprising a plane boundary cutting structure and a curved boundary cutting structure (the curved reticulated shell structure generated by the curved boundary in span direction cutting for the array combined revolution body belongs to cutting curved surface, and the generated curved reticulated shell structure is the curved boundary cutting structure); the curved reticulated shell structure is generated by the arching and curved surface of the plane boundary cutting structure, the plane boundary cutting structure respectively generates a one-way curved reticulated shell structure, a positive curvature two-way curved reticulated shell structure and a negative curvature two-way curved reticulated shell structure respectively through one-way bending arching, positive curvature two-way bending arching and negative curvature two-way bending arching.

Further, the curved reticulated shell structures are composed of the structural edges of the cutting surface and the surface edges of the original rhombic dodecahedron and the inner edges of the original rhombic dodecahedron, which are the rigidly connected spatial beam system structure.

Further, the rhombic dodecahedron is composed of twelve identical rhombus, and contains one edge length and two types of cross-nodes, and corresponding to the two types of cross-nodes, the number of connecting rods at each node is respectively three and four, there are fewer connecting rods of nodes, the structure is simple; the dodecahedron basic unit is composed of four rhombic dodecahedrons, which are formed by butting along the first plane oblique intersecting direction and second plane oblique intersecting direction that form an acute angle.

Further, the rhombic dodecahedron basic unit has repeatability in the directions of the three coordinate axes of the top view, the rear view and the left view.

Further, the rhombic dodecahedron basic unit can be in array replication along three orthogonal directions to form the orthogonal array combination body, so as to fill the entire three-dimensional space, this type of polyhedron is a space-filling polyhedron.

Further, the orthogonal array combination body can be rotated around any axis in space to generate the array combined revolution body; in order to make the rotated array combined revolution body has good regularity when cutting, it generally rotate around the X-axis, Y-axis, Z-axis or the space diagonal axis as the space rotation axis.

Further, the array combined revolution body is a densely filled space polyhedron, which can be cut through the building boundary to obtain a plate-shell shape structure that satisfies the building shape and structural rigidity, and can be used as the building roof or building wall for large-span spaces.

Further, the boundary cutting structure is formed by the building boundary cutting the array combined revolution body, in order to meet the reasonable requirements of large-span space and steel use, it is generally cut into the thinner two-dimensional plate-shell structure form; according to the cutting boundary form, including the plane boundary in span direction and the curved boundary in span direction, the corresponding plane boundary cutting structure and curved boundary cutting structure are generated; the cutting boundary in the thickness direction of the plate and shell structure is generally also the plane cutting boundary, that is, the plane boundary in thickness direction.

Further, the array combined revolution body is cut by the plane boundary in span direction to generate the plane boundary cutting structure, which is the plane rigid frame structure; when the space span is not more than 50 meters, the plane rigid frame structure can be directly applied to the roof structure of the large-span space.

Further, the array combined revolution body is cut by the curved boundary in span direction to generate a curved boundary cutting structure; that is curved reticulated shell structure; the curved surface shape of the curved boundary in span direction is determined according to the shape of the building boundary, generally including cylindrical shape, spherical shape, and hyperboloid shape; the one-way curved reticulated shell structure is a cylindrical reticulated shell structure, which is in the shape of the one-way curved zero Gaussian curvature surface; mainly suitable for one-way large-span space roof structure; the positive curvature two-way curved reticulated shell structure is a spherical reticulated shell structure, which is in the shape of two-way curved positive Gaussian curvature surface; mainly suitable for two-way large-span space roof structure; the negative curvature two-way curved reticulated shell structure is a hyperboloid reticulated shell structure, which is in the shape of two-way curved negative Gaussian curvature surface, compared with the cylindrical shape and the spherical shape, its stability is better, but the production is complicated, and it is mainly suitable for complex architectural roof structures with negative curvature surface shapes.

Further, the curved reticulated shell structure makes full use of the arc-axial compression bearing mode of the curved structure, compared with the plane rigid frame structure, it can effectively improve the bearing performance, increase the structural rigidity, and increase the space span.

Further, when cutting the surface, using the Boolean Operation Subtraction of the surface building boundary shape to cut the array combined revolution body to directly generate the curved reticulated shell structure, that is, the curved boundary cutting structure.

Further, when arching the surface, the arching and bending method is used for the plane boundary cutting structure to generate curved reticulated shell structures, comprising one-way bending arching, positive curvature two-way bending arching and negative curvature two-way bending arching, the curved surfaces are bent and positioned through the curved surface control lines of one-way bending arching, the curved surface control lines of positive curvature two-way bending arching and the curved surface control lines of negative curvature two-way bending arching, so as to generate the corresponding one-way curved reticulated shell structure, the positive curvature two-way curved reticulated shell structure and the negative curvature two-way curved reticulated shell structure.

Further, according to the control of the bending and arching forms of surfaces, the corresponding curved architectural shapes can be realized, including cylindrical shape, spherical shape, and hyperboloid shape; the cylindrical shape is one-way bending and arching, the spherical shape is positive curvature two-way bending and arching, and the hyperboloid shape is negative curvature two-way bending and arching; in practical engineering, the bending and arching of the cylindrical shape and spherical shape are easy to achieve.

Further, the curved reticulated shell structures include surface chord members and inner web members; both are bending beam elements; the surface chord members are located on the surfaces of the curved reticulated shell structures, comprising the structural edges of the cutting surface and the surface edges of the original rhombic dodecahedron; the structural edges of the cutting surface are the newly generated structural edges when the cutting surface passes through the surface of the Rhombic dodecahedron, the surface edges of the original Rhombic dodecahedron are the original structural edges when the cutting surface passes through the edges of the Rhombic dodecahedron; inner web members are located inside the curved reticulated shell structures, only composed of the inner edges of the original rhombic dodecahedron; the surface chord member is generally a box-section steel member, and the inner web member is generally a round tube-section steel member.

Further, the curved reticulated shell structures include internal nodes connected between internal web members and surface nodes connected between surface chord members, both of which are rigid joints; the internal nodes are located inside the curved reticulated shell structures and are welded hollow spherical nodes; the surface nodes are located on the surfaces of the curved reticulated shell structures and are welded hollow spherical nodes or drum nodes.

For the formation of the space curved reticulated shell structure formed by stacking and combining rhombic dodecahedrons, it needs to go through the process of combination, array, rotation, cutting and bending of polyhedral elements; therefore, the size of rhombic dodecahedron, space rotation axis, rotation angle, cutting position, the shape of cutting boundary, bending rise-span ratio, etc. are all important parameters that affect the geometric composition of the overall structure, and can be appropriately changed according to actual needs, and achieve different architectural appearance effects and structural optimization design.

The construction method of the space curved reticulated shell structure formed by stacking and combining rhombic dodecahedrons, comprising the following steps:

S1. Four rhombic dodecahedrons are butted along the first plane oblique intersecting direction and the second plane oblique intersecting direction of the plane bidirectional oblique intersecting to form the dodecahedron basic unit;

S2. The orthogonal array combination body is formed by the dodecahedron basic unit in array replication along three orthogonal directions;

S3. The array combined revolution body is generated by rotating the orthogonal array combination body around the space rotation axis by a certain angle;

S4. According to the building boundary cutting form, setting the plane boundary in span direction, the curved boundary in span direction and the plane boundary in thickness direction.

S5. The plane boundary cutting structure and the curved boundary cutting structure are generated by the plane boundary in span direction or the curved boundary in span direction cutting the array combined revolution body; the cutting methods of the plane boundary in span direction or the curved boundary in span direction include the three-dimensional model cutting method and the coordinate positioning cutting method;

S6. On the basis of the plane boundary cutting structure generated in step S5, curved reticulated shell structures are generated by controlling the arching and curved surface method, that is, the plane boundary cutting structure adopts one-way bending arching, positive curvature two-way bending arching and negative curvature two-way bending arching to generate curved reticulated shell structures, the curved surfaces are bent and positioned through the corresponding curved surface control lines of one-way bending arching, the curved surface control lines of positive curvature two-way bending arching and the curved surface control lines of negative curvature two-way bending arching, so as to generate the corresponding one-way curved reticulated shell structure, the positive curvature two-way curved reticulated shell structure and the negative curvature two-way curved reticulated shell structure; wherein the bending methods of one-way bending arching, positive curvature two-way bending arching and negative curvature two-way bending arching include three-dimensional model bending method and coordinate positioning bending method;

S7. The generated curved reticulated shell structures are composed of the structural edges of the cutting surface and the surface edges of the original rhombic dodecahedron and the inner edges of the original rhombic dodecahedron, which are the spatial beam system structure; the members include surface chord members and inner web members, and the nodes include internal nodes connected between internal web members and surface nodes connected between surface chord members.

Further, in step S5, the implementation steps of the three-dimensional model cutting method: first, establishing a 3D solid element model in the CAD software, that is, an array combined revolution body composed of solid rhombic dodecahedrons; and then establishing the plane domain boundary and the curved domain boundary (cylindrical domain, spherical domain, hyperboloid domain) generated by the plane boundary in span direction and the curved boundary in span direction; switching to the side view, realizing the plane cutting of the 3D solid element model through the Solid Split Operation of the plane domain boundary, and realizing the cylindrical and spherical cutting of the 3D solid element model through the Boolean Subtraction Operation of the cylindrical domain boundary and the spherical domain boundary, this method is fast and effective; realizing the more complex hyperboloid cutting through hyperboloid domain cutting in Rhino software, which is relatively complex.

Further, the array combined revolution body of plane cutting and surface cutting (cylinder, sphere, hyperboloid) must be composed of solid rhombic dodecahedron, not the Wireframe rhombic dodecahedron; the array combined revolution body composed of solid rhombic dodecahedron can directly generate the structural edges of the cutting surface after cutting, and finally exploding the solid to generate the Wireframe structure, this method is simple to operate, practical and efficient; after cutting, the array combined revolution body composed of Wireframe rhombic dodecahedron needs to connect the nearest adjacent nodes on the edge to generate the structural edges of the cutting surface, this operation is relatively complex.

Further, in step S5, the implementation steps of the coordinate positioning cutting method: first, digitizing the node coordinates of the array combined revolution body, and importing the input node data file of MATLAB, and then setting the plane boundary in span direction and the curved boundary in span direction of the numerical positioning; writing the corresponding cutting programs respectively to generate the plane boundary cutting structure and curved boundary cutting structure; the control method of the cutting programs is that the nodes and members within the cutting range are retained, the nodes and members outside the cutting range are deleted, and nodes are generated at the intersection of the cutting planes, and finally the nearest adjacent nodes on the cutting planes are connected to generate the structural edges of the cutting surface, the operation is relatively complex, but it is easy to implement parametric modeling.

Further, in step S6, the implementation steps of the three-dimensional model bending method: first, establishing a 3D solid element model in the CAD software, that is, an array combined revolution body composed of solid rhombic dodecahedrons; and then establishing the plane domain boundary generated by the plane boundary in span direction; switching to the top view, realizing the plane cutting of the 3D solid element model through the Solid Split Operation of the plane domain boundary to obtain the plane boundary cutting structure, which is the plane frame rigid structure; then, exploding the solid to generate the Wireframe structure, and importing it into Rhino software; positioning the curved surface control lines of one-way bending arching, the curved surface control lines of positive curvature two-way bending arching and the curved surface control lines of negative curvature two-way bending arching through the "bending" function in Rhino software, so as to realize one-way bending arching, positive curvature two-way bending arching and negative curvature two-way bending arching to generate the curved reticulated shell structures, this method is fast and effective.

Further, in step S6, the implementation steps of the coordinate positioning bending method: first, digitizing the node coordinates of the array combined revolution body, and importing the input node data file of MATLAB, and then deducing the node coordinate conversion formulas corresponding to one-way bending, positive curvature two-way bending and negative curvature two-way bending and digitizing them; writing corresponding bending conversion programs respectively to generate the one-way curved reticulated shell structure, the positive curvature two-way curved reticulated shell structure and the negative curvature two-way curved reticulated shell structure.

Further, the coordinate positioning bending method can realize the bending transformation of any surface, and generate the complex curved surface reticulated shell structure, it can be applied to a wide range of surfaces and is easy to achieve parametric modeling, however, the operation is complicated, and the digitalization of bending transformation is difficult.

Further, the one-way curved reticulated shell structure, the positive curvature two-way curved reticulated shell structure, and the negative curvature two-way curved reticulated shell structure generated after bending and arching are all Wireframe structures, by importing MSTCAD software and removing redundant members, the node coordinate data and element data can be extracted, and structural bearing analysis can be performed.

Further, in the method of generating the curved reticulated shell structure by surface cutting, the number, length and included angle of the connecting rods of nodes remain unchanged, but the grid may be messy after cutting, and there are certain restrictions on the cutting position and cutting surface; in the method of generating curved reticulated shell structure by bending and arching, there are only two topological forms of surface patterns, the length and included angle of the connecting rods of nodes slightly change according to the rise-span ratio of the bending and arching, but the grid is regular and the repeatability is high, which is easy to ensure the rationality and feasibility of the structure.

The invention has the following advantageous effects: the invention provides a space curved reticulated shell structure formed by stacking and combining rhombic dodecahedrons, which is a new type of space structure, compared with the traditional space grid structure and reticulated shell structure, the invention has the advantages of repeated array effect, fewer connecting rods of nodes, fewer rod specifications, large earthquake-resistant ductility, beautiful appearance, etc, it can be applied to the roof and wall structure of large-span curved buildings such as exhibition halls and gymnasiums, and has broad prospects.

4. BRIEF DESCRIPTION OF ACCOMPANY DRAWINGS

FIG. 1 is the structural schematic diagram of the embodiments of a space curved reticulated shell structure formed by stacking and combining rhombic dodecahedrons of the invention (FIG. 1*a*-FIG. 1*c* are the structural schematic diagrams of the one-way curved reticulated shell structure, the positive curvature two-way curved reticulated shell structure and the negative curvature two-way curved reticulated shell structure respectively);

FIG. 2 is the top plan view of the embodiments of the space curved reticulated shell structures of the invention, namely A-A cutaway schematic diagram in FIG. 1 (FIG. 2*a*-FIG. 2*c* are the top plan views of the one-way curved reticulated shell structure, the positive curvature two-way curved reticulated shell structure and the negative curvature two-way curved reticulated shell structure respectively);

FIG. 3 is the cutaway front view of the embodiments of the space curved reticulated shell structures of the invention, namely B-B cutaway schematic diagram in FIG. 1 (FIG. 3*a*-FIG. 3*c* are the cutaway front views of the one-way curved reticulated shell structure, the positive curvature two-way curved reticulated shell structure and the negative curvature two-way curved reticulated shell structure respectively);

FIG. 4 is the cutaway right view of the embodiments of the space curved reticulated shell structures of the invention, namely C-C cutaway schematic diagram in FIG. 1 (FIG. 4*a*-FIG. 4*c* are the cutaway right views of the one-way curved reticulated shell structure, the positive curvature two-way curved reticulated shell structure and the negative curvature two-way curved reticulated shell structure respectively);

FIG. 5*a*-FIG. 5*d* are the schematic diagrams of the Rhombic dodecahedron, Rhombic dodecahedron basic unit, orthogonal array combination body, array combined revolution body respectively;

FIG. 7 is the structural schematic diagram of the curved reticulated shell structures generated by boundary cutting

Figure 9:
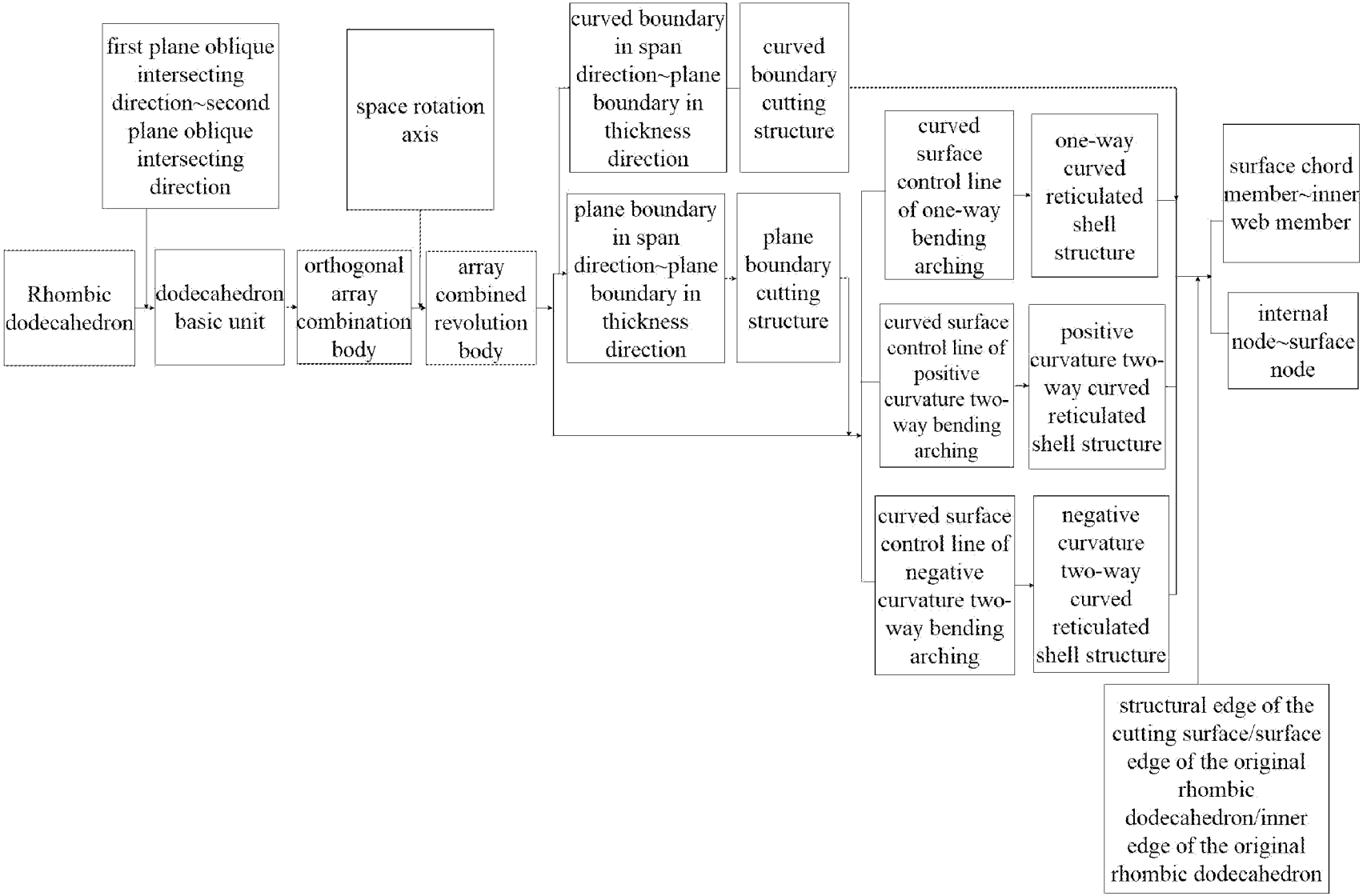

FIG. 8 is the structural schematic diagram of the curved reticulated shell structures generated by bending and arching (FIG. 8*a*-FIG. 8*f* are the schematic diagrams of the layout of one-way bending arching, the layout of positive curvature two-way bending arching, the layout of negative curvature two-way bending arching, one-way curved reticulated shell structure, positive curvature two-way curved reticulated shell structure and negative curvature two-way curved reticulated shell structure respectively);

FIG. 9 is the flow chart of the composition of the embodiments of the space curved reticulated shell structure formed by stacking and combining rhombic dodecahedrons of the invention.

As shown in the accompanying drawings: 1 Rhombic dodecahedron; 2 dodecahedron basic unit; 3 first plane oblique intersecting direction; 4 second plane oblique intersecting direction; 5 orthogonal array combination body; 6 array combined revolution body; 7 space rotation axis; 8 plane boundary in span direction; 9 curved boundary in span direction; 10 plane boundary in thickness direction; 11 plane boundary cutting structure; 12 curved boundary cutting structure; 13 structural edge of the cutting surface; 14 surface edge of the original rhombic dodecahedron; 15 curved surface control line of one-way bending arching; 16 curved surface control line of positive curvature two-way bending arching; 17 curved surface control line of negative curvature two-way bending arching; 18 one-way curved reticulated shell structure; 19 positive curvature two-way curved reticulated shell structure; 20 negative curvature two-way curved reticulated shell structure; 21 surface chord member; 22 inner web member; 23 inner edge of the original rhombic dodecahedron; 24 internal node; 25 surface node.

5. SPECIFIC EMBODIMENT OF THE INVENTION

The invention will be further described below in combination with the embodiments. The description of the following embodiments is only used to help understand the invention. It should be pointed out that for those skilled in the art, without departing from the principle of the invention, several improvements and modifications can also be made to the invention, and these improvements and modifications also fall within the protection scope of the claims of the invention.

Embodiment 1

The space curved reticulated shell structure formed by stacking and combining rhombic dodecahedrons provided by embodiment 1 of the invention, as shown in FIG. 1*a*-FIG. 1*c*, FIG. 5*a*-FIG. 5*d*, FIG. 7*c*-FIG. 7*d*, the rhombic dodecahedron (FIG. 5*a*) is a polyhedron composed of twelve congruent rhombus; the dodecahedron basic unit (FIG. 5*b*) is formed by the bidirectional oblique butting of four rhombic dodecahedrons along the plane; the orthogonal array combination body (FIG. 5*c*) is formed by the dodecahedron basic unit in array replication along three orthogonal directions; the array combined revolution body (FIG. 5*d*) is generated by rotating the orthogonal array combination body around the space rotation axis by a certain angle; boundary cutting structures (FIG. 7*c*-FIG. 7*d*) are generated by the building boundary cutting the array combined revolution body, comprising a plane boundary cutting structure and a curved boundary cutting structure (the curved reticulated shell structure generated by the curved boundary in span direction cutting for the array combined revolution body belongs to cutting curved surface, and the generated curved reticulated shell structure is the curved boundary cutting structure); the curved reticulated shell structures (FIG. 1*a*-FIG. 1*c*) are generated from the curved surface of the boundary cutting structures; cutting curved surface is a curved reticulated shell structure generated by the surface building boundary cutting for the array combined revolution body, that is, the curved boundary cutting structure; arching and curved surface means that the plane boundary cutting structure adopts one-way bending arching, positive curvature two-way bending arching or negative curvature two-way bending arching to generate curved reticulated shell structures.

As shown in FIG. 1*a*-FIG. 1*c*, FIG. 2*a*-FIG. 2*c*, FIG. 3*a*-FIG. 3*c*, FIG. 4*a*-FIG. 4*c*, the curved reticulated shell structures are composed of the structural edges of the cutting surface 13 and the surface edges of the original rhombic dodecahedron 14 and the inner edges of the original rhombic dodecahedron 23, which are the rigidly connected spatial beam system structure.

As shown in FIG. 1*a*-FIG. 1*c*, FIG. 5*a*-FIG. 5*d*, the rhombic dodecahedron 1 is composed of twelve identical rhombus, and contains one edge length and two types of cross-nodes, and corresponding to the two types of cross-nodes, the number of connecting rods at each node is respectively three and four, there are fewer connecting rods of nodes, the structure is simple; the dodecahedron basic unit 2 is composed of four rhombic dodecahedrons 1, which are formed by butting along the first plane oblique intersecting direction 3 and second plane oblique intersecting direction 4 that form an acute angle.

As shown in FIG. 1*a*-FIG. 1*c*, FIG. 5*a*-FIG. 5*d*, the rhombic dodecahedron basic unit 2 has repeatability in the directions of the three coordinate axes of the top view, the rear view and the left view.

As shown in FIG. 5*a*-FIG. 5*d*, the rhombic dodecahedron basic unit 2 can be in array replication along three orthogonal directions to form the orthogonal array combination body 5, so as to fill the entire three-dimensional space, this type of polyhedron is a space-filling polyhedron.

As shown in FIG. 5*a*-FIG. 5*d*, FIG. 6, the orthogonal array combination body 5 can be rotated around any axis in space to generate the array combined revolution body 6; in order to make the rotated array combined revolution body 6 has good regularity when cutting, it generally rotate around the X-axis, Y-axis, Z-axis or the space diagonal axis as the space rotation axis 7. In this embodiment, the space rotation axis 7 is the space diagonal axis, and the orthogonal array combination body 5 is rotated by 60° around the space diagonal axis to generate the array combined revolution body 6.

As shown in FIG. 1*a*-FIG. 1*c*, FIG. 7*a*-FIG. 7*d*, the array combined revolution body 6 is a densely filled space polyhedron, which can be cut through the building boundary to obtain a plate-shell shape structure that satisfies the building shape and structural rigidity, and can be used as the building roof or building wall for large-span spaces.

As shown in FIG. 7*a*-FIG. 7*d*, the boundary cutting structure is formed by the building boundary cutting the array combined revolution body 6, in order to meet the reasonable requirements of large-span space and steel use, it is generally cut into the thinner two-dimensional plate-shell structure form; according to the cutting boundary form, including the plane boundary in span direction 8 and the curved boundary in span direction 9, the corresponding plane boundary cutting structure 11 and curved boundary cutting structure 12 are generated; the cutting boundary in the thickness direction of the plate and shell structure is generally also the plane cutting boundary, that is, the plane boundary in thickness direction 10.

As shown in FIG. 7*a*-FIG. 7*d*, the array combined revolution body 6 is cut by the plane boundary in span direction 8 to generate the plane boundary cutting structure 11, which is the plane rigid frame structure; when the space span is not more than 50 meters, the plane rigid frame structure can be directly applied to the roof structure of the large-span space.

As shown in FIG. 7*a*-FIG. 7*d*, the array combined revolution body 6 is cut by the curved boundary in span direction 9 to generate a curved boundary cutting structure 12; that is curved reticulated shell structure; the curved surface shape of the curved boundary in span direction 9 is determined according to the shape of the building boundary, generally including cylindrical shape, spherical shape, and hyperboloid shape. In this embodiment, the curved surface shape of the curved boundary in span direction 9 is a cylindrical shape, and the generated curved boundary cutting structure 12 is a cylindrical reticulated shell structure, which is the easiest to implement in practical engineering.

As shown in FIG. 7*a*-FIG. 7*d*, the cutting of the plane boundary in span direction 8 and the curved boundary in span direction 9 is generally realized by the three-dimensional model cutting method and the coordinate positioning cutting method.

As shown in FIG. 1*a*-FIG. 1*c*, FIG. 7*a*-FIG. 7*d*, the implementation steps of the three-dimensional model cutting method: first, establishing a 3D solid element model in the CAD software, that is, an array combined revolution body 6 composed of solid rhombic dodecahedrons 1; and then establishing the plane domain boundary and the curved domain boundary (cylindrical domain, spherical domain, hyperboloid domain) generated by the plane boundary in span direction 8 and the curved boundary in span direction 9; switching to the side view, realizing the plane cutting of the 3D solid element model through the Solid Split Operation of the plane domain boundary, and realizing the cylindrical and spherical cutting of the 3D solid element model through the Boolean Subtraction Operation of the cylindrical domain boundary and the spherical domain boundary, this method is fast and effective; realizing the more complex hyperboloid cutting through hyperboloid domain cutting in Rhino software, which is relatively complex.

As shown in FIG. 7*a*-FIG. 7*d*, the array combined revolution body 6 of plane cutting and surface cutting (cylinder, sphere, hyperboloid) must be composed of solid rhombic dodecahedron, not the Wireframe rhombic dodecahedron; the array combined revolution body 6 composed of solid rhombic dodecahedron can directly generate the structural edges of the cutting surface 13 after cutting, and finally exploding the solid to generate the Wireframe structure, this method is simple to operate, practical and efficient; after cutting, the array combined revolution body 6 composed of Wireframe rhombic dodecahedron needs to connect the nearest adjacent nodes on the edge to generate the structural edges of the cutting surface 13, this operation is relatively complex.

As shown in FIG. 7*a*-FIG. 7*d*, the implementation steps of the coordinate positioning cutting method: first, digitizing the node coordinates of the array combined revolution body 6, and importing the input node data file of MATLAB, and then setting the plane boundary in span direction 8 and the curved boundary in span direction 9 of the numerical positioning; writing the corresponding cutting programs respectively to generate the plane boundary cutting structure 11 and curved boundary cutting structure 12; the control method of the cutting programs is that the nodes and members within the cutting range are retained, the nodes and members outside the cutting range are deleted, and nodes are generated at the intersection of the cutting planes, and finally the nearest adjacent nodes on the cutting planes are connected to generate the structural edges of the cutting surface 13, the operation is relatively complex, but it is easy to implement parametric modeling.

As shown in FIG. 1*a*-FIG. 1*c*, FIG. 8*a*-FIG. 8*f*, the curved reticulated shell structures are generated from the curved surface of the boundary cutting structure, including cutting curved surface and arching curved surface; the curved reticulated shell structure makes full use of the arc-axial compression bearing mode of the curved structure, compared with the plane rigid frame structure, it can effectively improve the bearing performance, increase the structural rigidity, and increase the space span.

As shown in FIG. 1*a*-FIG. 1*c*, FIG. 7*b*, FIG. 7*d*, when cutting the surface, using the Boolean Operation Subtraction of the surface building boundary shape to cut the array combined revolution body 6 to directly generate the curved reticulated shell structure, that is, the curved boundary cutting structure 12.

As shown in FIG. 1*a*-FIG. 1*c*, FIG. 8*a*-FIG. 8*f*, when arching the surface, the arching and bending method is used for the plane boundary cutting structure 11 to generate curved reticulated shell structures, comprising one-way bending arching, positive curvature two-way bending arching and negative curvature two-way bending arching, the curved surfaces are bent and positioned through the curved surface control lines of one-way bending arching 15, the curved surface control lines of positive curvature two-way bending arching 16 and the curved surface control lines of negative curvature two-way bending arching 17, so as to generate the corresponding one-way curved reticulated shell structure 18, the positive curvature two-way curved reticulated shell structure 19 and the negative curvature two-way curved reticulated shell structure 20. In this embodiment, the one-way curved reticulated shell structure 18, the positive curvature two-way curved reticulated shell structure 19 and the negative curvature two-way curved reticulated shell structure 20 are respectively the cylindrical reticulated shell structure, the spherical reticulated shell structure and the hyperboloid reticulated shell structure.

As shown in FIG. 8*a*-FIG. 8*f*, according to the control of the bending and arching forms of surfaces, the corresponding curved architectural shapes can be realized, including cylindrical shape, spherical shape, and hyperboloid shape; the cylindrical shape is one-way bending and arching, the spherical shape is positive curvature two-way bending and arching, and the hyperboloid shape is negative curvature two-way bending and arching; in practical engineering, the bending and arching of the cylindrical shape and spherical shape are easy to achieve.

As shown in FIG. 8*a*-FIG. 8*f*, the bendings of one-way bending arching, positive curvature two-way bending arching and negative curvature two-way bending arching are generally realized by the three-dimensional model bending method and coordinate positioning bending method;

As shown in FIG. 1*a*-FIG. 1*c*, FIG. 8*a*-FIG. 8*f*, the implementation steps of the three-dimensional model bending method: first, establishing a 3D solid element model in the CAD software, that is, an array combined revolution body 6 composed of solid rhombic dodecahedrons 1; and then establishing the plane domain boundary generated by the plane boundary in span direction 8; switching to the top view, realizing the plane cutting of the 3D solid element model through the Solid Split Operation of the plane domain boundary to obtain the plane boundary cutting structure 11, which is the plane frame rigid structure; then, exploding the solid to generate the Wireframe structure, and importing it into Rhino software; positioning the curved surface control lines of one-way bending arching 15, the curved surface control lines of positive curvature two-way bending arching 16 and the curved surface control lines of negative curvature two-way bending arching 17 through the "bending" function in Rhino software, so as to realize one-way bending arching, positive curvature two-way bending arching and negative curvature two-way bending arching to generate the curved reticulated shell structures, this method is fast and effective.

As shown in FIG. 8*a*-FIG. 8*f*, the implementation steps of the coordinate positioning bending method: first, digitizing the node coordinates of the array combined revolution body 6, and importing the input node data file of MATLAB, and then deducing the node coordinate conversion formulas corresponding to one-way bending, positive curvature two-way bending and negative curvature two-way bending and digitizing them; writing corresponding bending conversion programs respectively to generate the one-way curved reticulated shell structure 18, the positive curvature two-way curved reticulated shell structure 19 and the negative curvature two-way curved reticulated shell structure 20.

As shown in FIG. 8*a*-FIG. 8*f*, the coordinate positioning bending method can realize the bending transformation of any surface, and generate the complex curved surface reticulated shell structure, it can be applied to a wide range of surfaces and is easy to achieve parametric modeling, however, the operation is complicated, and the digitalization of bending transformation is difficult.

As shown in FIG. 8*a*-FIG. 8*f*, the one-way curved reticulated shell structure 18, the positive curvature two-way curved reticulated shell structure 19, and the negative curvature two-way curved reticulated shell structure 20 generated after bending and arching are all Wireframe structures, by importing MSTCAD software and removing redundant members, the node coordinate data and element data can be extracted, and structural bearing analysis can be performed.

As shown in FIG. 1*a*-FIG. 1*c*, FIG. 7*a*-FIG. 7*d*, FIG. 8*a*-FIG. 8*f*, in the method of generating the curved reticulated shell structure by surface cutting, the number, length and included angle of the connecting rods of nodes remain unchanged, but the grid may be messy after cutting, and there are certain restrictions on the cutting position and cutting surface; in the method of generating curved reticulated shell structure by bending and arching, there are only two topological forms of surface patterns, the length and included angle of the connecting rods of nodes slightly change according to the rise-span ratio of the bending and arching, but the grid is regular and the repeatability is high, which is easy to ensure the rationality and feasibility of the structure.

As shown in FIG. 1*a*-FIG. 1*c*, FIG. 2*a*-FIG. 2*c*, FIG. 3*a*-FIG. 3*c*, FIG. 4*a*-FIG. 4*c*, the curved reticulated shell structures include surface chord members 21 and inner web members 22; both are bending beam elements; the surface chord members 21 are located on the surfaces of the curved reticulated shell structures, comprising the structural edges of the cutting surface 13 and the surface edges of the original rhombic dodecahedron 14; the structural edges of the cutting surface 13 are the newly generated structural edges when the cutting surface passes through the surface of the Rhombic dodecahedron 1, the surface edges of the original Rhombic dodecahedron 14 are the original structural edges when the cutting surface passes through the edges of the Rhombic dodecahedron 1; inner web members 22 are located inside the curved reticulated shell structures, only composed of the inner edges of the original rhombic dodecahedron 23; the surface chord member 21 is generally a box-section steel member, and the inner web member 22 is generally a round tube-section steel member.

As shown in FIG. 1*a*-FIG. 1*c*, FIG. 3*a*-FIG. 3*c*, the curved reticulated shell structures include internal nodes 24 connected between internal web members 22 and surface nodes 25 connected between surface chord members 21, both of which are rigid joints; the internal nodes 24 are located inside the curved reticulated shell structures and are welded hollow spherical nodes; the surface nodes 25 are located on the surfaces of the curved reticulated shell structures and are welded hollow spherical nodes or drum nodes.

For the formation of the space curved reticulated shell structure formed by stacking and combining rhombic dodecahedrons, it needs to go through the process of combination, array, rotation, cutting and bending of polyhedral elements; therefore, the size of rhombic dodecahedron, space rotation axis, rotation angle, cutting position, the shape of cutting boundary, bending rise-span ratio, etc. are all important parameters that affect the geometric composition of the overall structure, and can be appropriately changed according to actual needs, and achieve different architectural appearance effects and structural optimization design.

Embodiment 2

The embodiment 2 of the invention provides a construction method of the space curved reticulated shell structure formed by stacking and combining rhombic dodecahedrons, referring to FIG. 9, comprising the following steps:

S1. Four rhombic dodecahedrons 1 are butted along the first plane oblique intersecting direction 3 and the second plane oblique intersecting direction 4 of the plane bidirectional oblique intersecting to form the dodecahedron basic unit 2;

S2. The orthogonal array combination body 5 is formed by the dodecahedron basic unit 2 in array replication along three orthogonal directions;

S3. The array combined revolution body 6 is generated by rotating the orthogonal array combination body 5 around the space rotation axis 7 by a certain angle;

S4. According to the building boundary cutting form, setting the plane boundary in span direction 8, the curved boundary in span direction 9 and the plane boundary in thickness direction 10.

S5. The plane boundary cutting structure 11 and the curved boundary cutting structure 12 are generated by the plane boundary in span direction 8 and the curved boundary in span direction 9 cutting the array combined revolution body 6; the cutting methods of the plane boundary in span direction 8 and the curved boundary in span direction 9 include the three-dimensional model cutting method and the coordinate positioning cutting method;

S6. On the basis of the plane boundary cutting structure 11 generated in step S5, curved reticulated shell structures are generated by controlling the arching and curved surface method, that is, the plane boundary cutting structure 11 adopts one-way bending arching, positive curvature two-way bending arching and negative curvature two-way bending arching to generate curved reticulated shell structures, the curved surfaces are bent and positioned through the corresponding curved surface control lines of one-way bending arching 15, the curved surface control lines of positive curvature two-way bending arching 16 and the curved surface control lines of negative curvature two-way bending arching 17, so as to generate the corresponding one-way curved reticulated shell structure 18, the positive curvature two-way curved reticulated shell structure 19 and the negative curvature two-way curved reticulated shell structure 20; wherein the bending methods of one-way bending arching, positive curvature two-way bending arching and negative curvature two-way bending arching include three-dimensional model bending method and coordinate positioning bending method;

S7. The generated curved reticulated shell structures are composed of the structural edges of the cutting surface 13 and the surface edges of the original rhombic dodecahedron 14 and the inner edges of the original rhombic dodecahedron 23, which are the spatial beam system structure; the members include surface chord members 21 and inner web members 22, and the nodes include internal nodes 24 connected between internal web members 22 and surface nodes 25 connected between surface chord members 21.

Embodiment 3

Figure 1A:
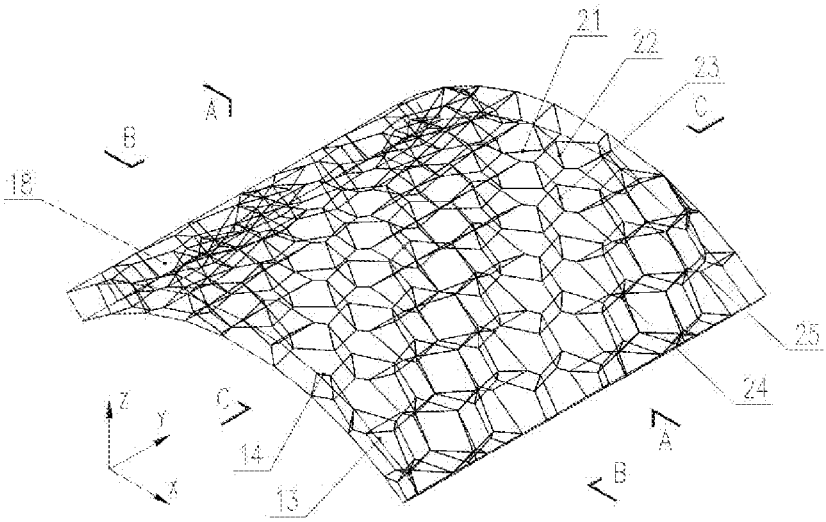

The object of the embodiment 3 of the invention is to form a cylindrical reticulated shell structure with a span of 40 m×40 m, a thickness of 3.0 m, and a rise-span ratio of ⅙, as shown in FIG. 1*a*. Using a 4 m-sized unit (the distance between the two surfaces of the rhombic dodecahedron is the unit size), the dodecahedron basic unit 2 is generated by the bidirectional oblique intersecting of 4 rhombic dodecahedrons 1, and then it is in array replication along the orthogonal directions of the three coordinate axes to form the orthogonal array combination body 5, the orthogonal array combination body 5 is then rotated 60 degrees around the space diagonal axis (0, 0, 0)→(1, 1, 1), which is the vector axis, so as to form the array combined revolution body 6, then, cutting out the building space according to the building boundary of 40 m×40 m×3 m to obtain the plane boundary cutting structure 11, finally, one-way bending and arching it according to the rise-span ratio of ⅙ to generate the cylindrical reticulated shell structure described in the invention, which belongs to the one-way curved reticulated shell structure 18.

Embodiment 4

Figure 1B:
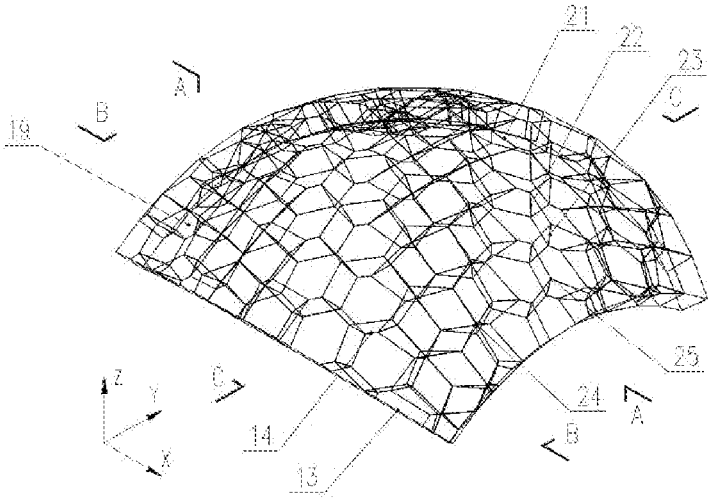

The object of the embodiment 4 of the invention is to form a spherical reticulated shell structure with a span of 40 m×40 m, a thickness of 3.0 m, and a positive curvature two-way rise-span ratio of ⅙, as shown in FIG. 1*b*. Using a 4 m-sized unit (the distance between the two surfaces of the rhombic dodecahedron is the unit size), the dodecahedron basic unit 2 is generated by the bidirectional oblique intersecting of 4 rhombic dodecahedrons 1, and then it is in array replication along the orthogonal directions of the three coordinate axes to form the orthogonal array combination body 5, the orthogonal array combination body 5 is then rotated 60 degrees around the space diagonal axis (0, 0, 0)→(1, 1, 1), which is the vector axis, so as to form the array combined revolution body 6, then, cutting out the building space according to the building boundary of 40 m×40 m×3 m to obtain the plane boundary cutting structure 11, finally, bending and arching it according to the positive curvature two-way rise-span ratio of ⅙ to generate the spherical reticulated shell structure described in the invention, which belongs to the positive curvature two-way curved reticulated shell structure 19.

Embodiment 5

Figure 1C:
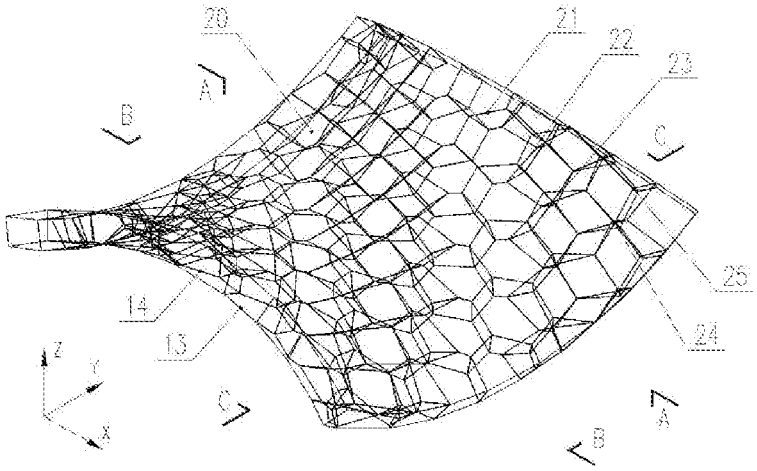
Figure 2A:
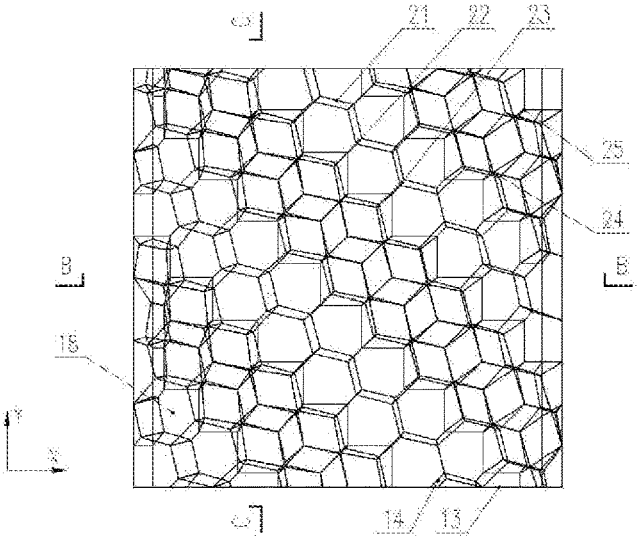
Figure 2B:
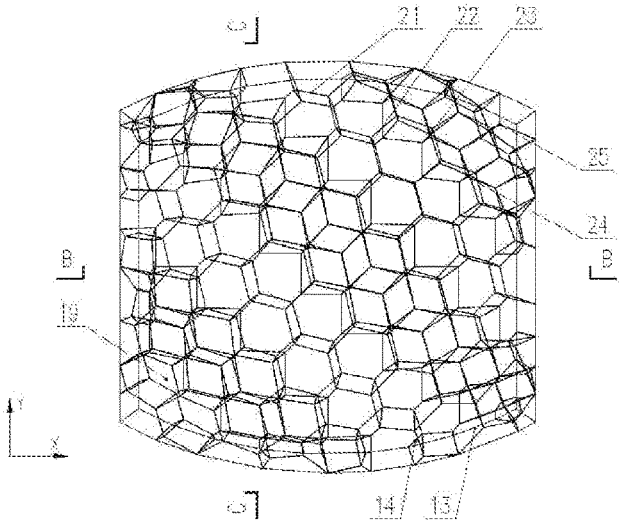
Figure 2C:
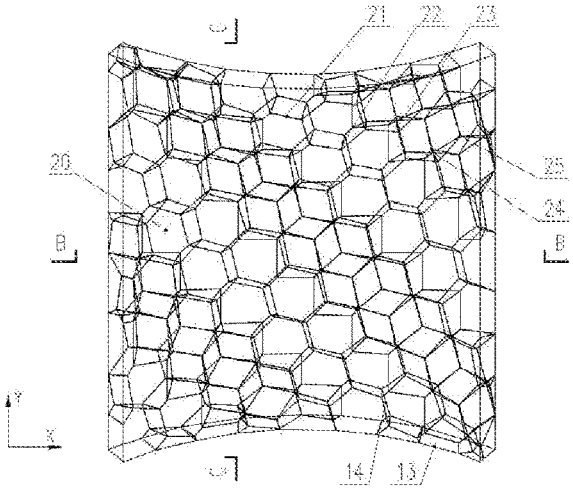
Figure 3A:
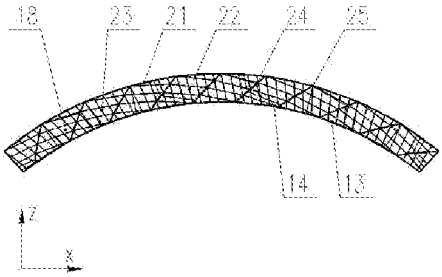
Figure 3B:
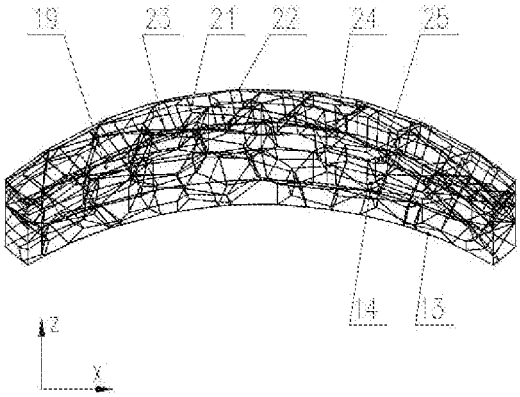
Figure 3C:
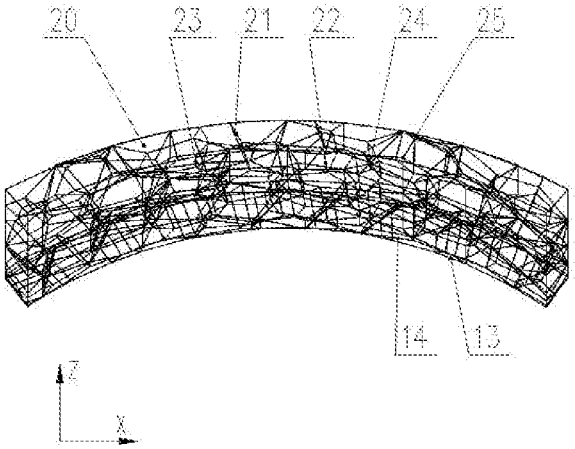
Figure 4A:
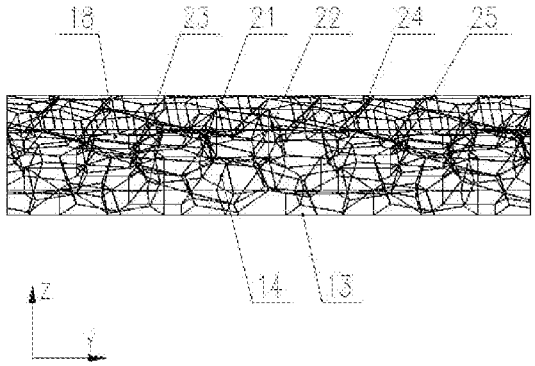
Figure 4B:
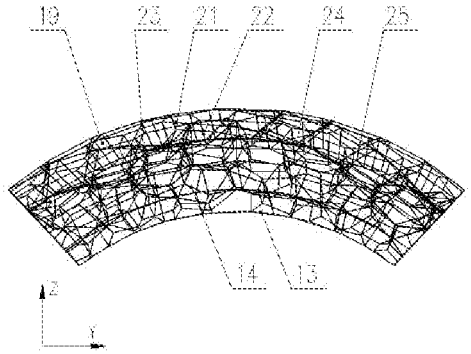
Figure 4C:
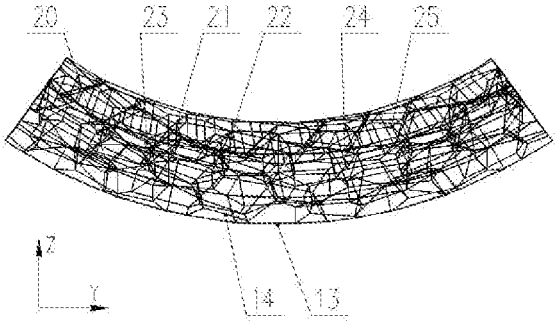
Figure 5A:
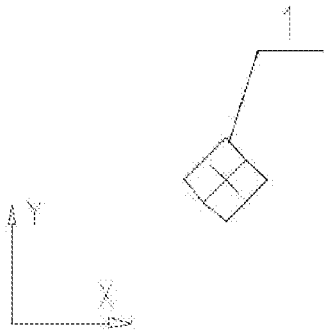
Figure 5B:
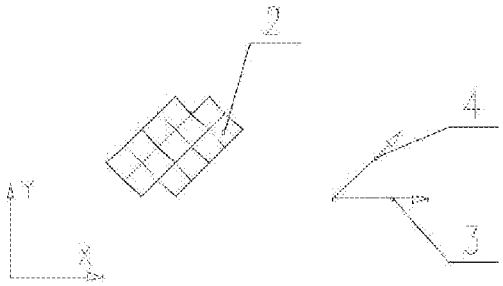
Figure 5C:
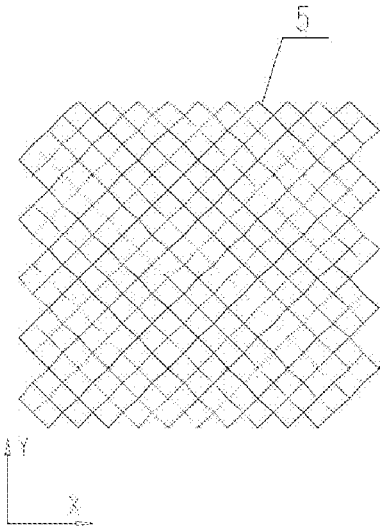
Figure 5D:
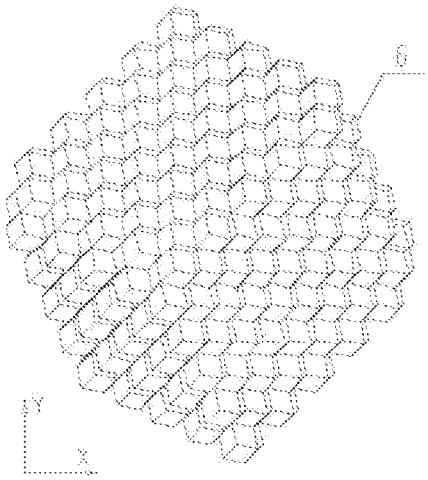
Figure 6:
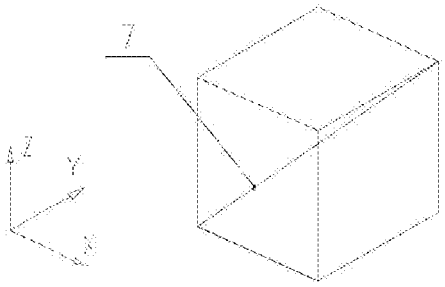
FIG. 6 is the positioning diagram of the space diagonal axis of the orthogonal array combination body as the space rotation axis.
Figure 7A:
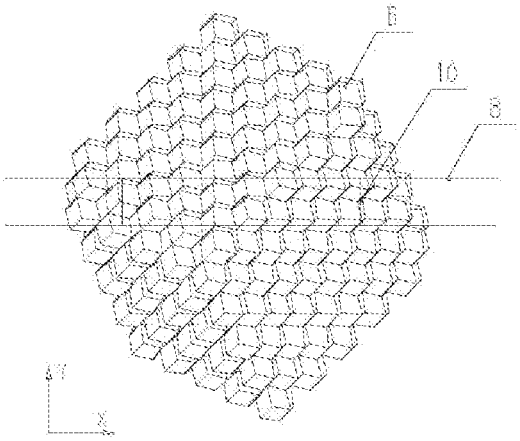
(FIG. 7*a*-FIG. 7*d* are the schematic diagrams of the layout of plane boundary cutting, the layout of curved boundary cutting, the plane boundary cutting structure, and the curved boundary cutting structure respectively)
Figure 7B:
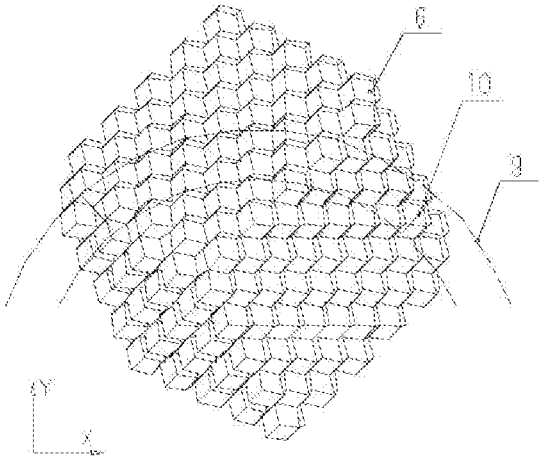
Figure 7C:
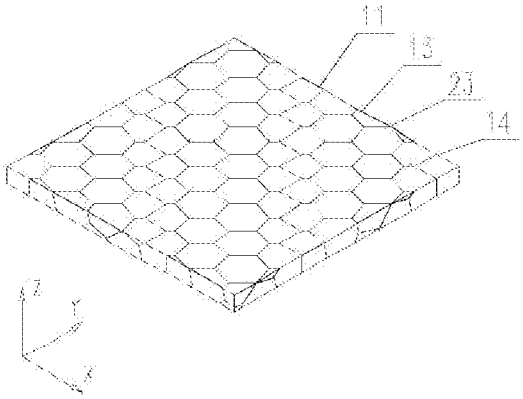
Figure 7D:
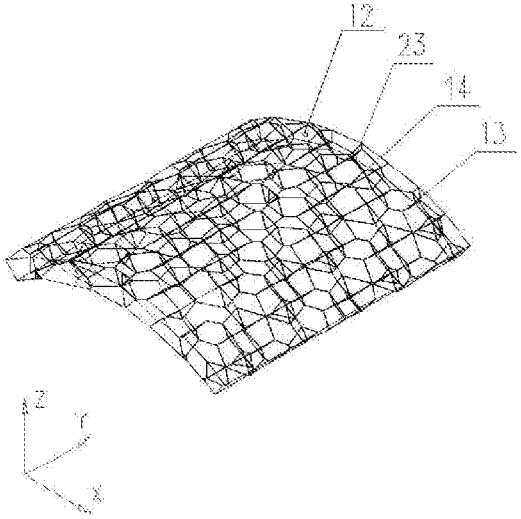
Figure 8A:
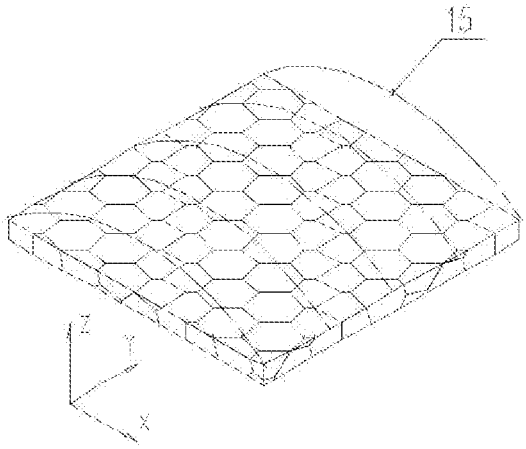
Figure 8B:
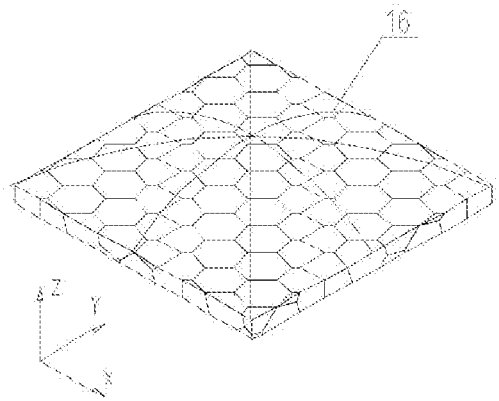
Figure 8C:
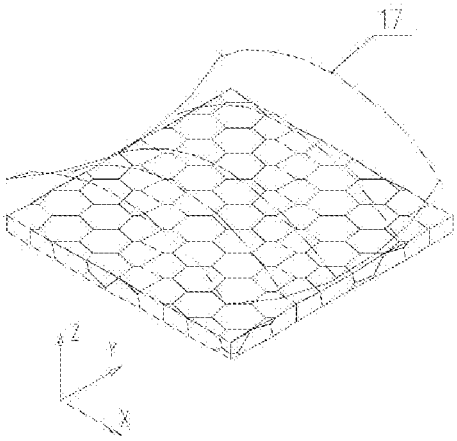
Figure 8D:
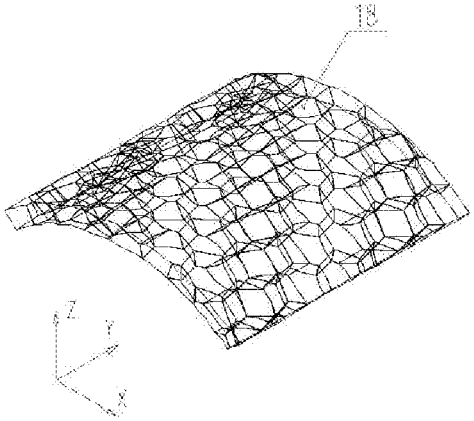
Figure 8E:
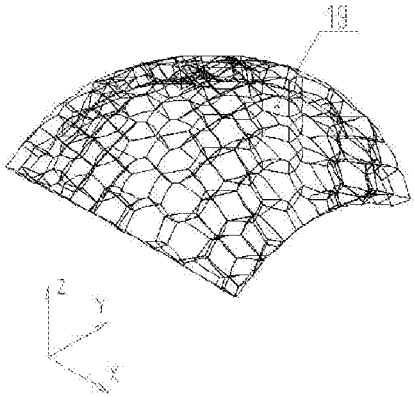
Figure 8F:
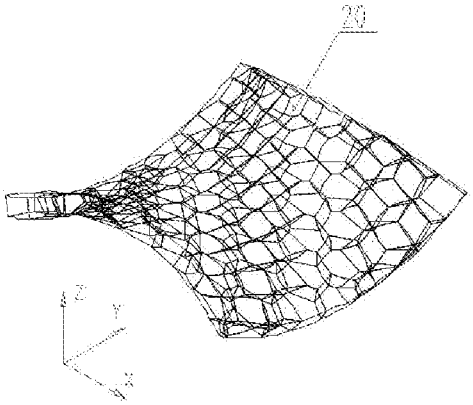

The object of the embodiment 5 of the invention is to form a hyperboloid reticulated shell structure with a span of 40 m×40 m, a thickness of 3.0 m, and a negative curvature two-way rise-span ratio of ⅙, as shown in FIG. 1*c*. Using a 4 m-sized unit (the distance between the two surfaces of the rhombic dodecahedron is the unit size), the dodecahedron basic unit 2 is generated by the bidirectional oblique intersecting of 4 rhombic dodecahedrons 1, and then it is in array replication along the orthogonal directions of the three coordinate axes to form the orthogonal array combination body 5, the orthogonal array combination body 5 is then rotated 60 degrees around the space diagonal axis (0, 0, 0)→(1, 1, 1), which is the vector axis, so as to form the array combined revolution body 6, then, cutting out the building space according to the building boundary of 40 m×40 m×3 m to obtain the plane boundary cutting structure 11, finally, bending and arching it according to the negative curvature two-way rise-span ratio of ⅙ to generate the hyperboloid reticulated shell structure described in the invention, which belongs to the negative curvature two-way curved reticulated shell structure 20.

Embodiment 6

The embodiment 6 of the invention provides a space curved reticulated shell structure formed by stacking and combining rhombic dodecahedrons to realize the design and load bearing of large-span space curved roof and wall structure systems, which have repeated array effect, simple node structure, large earthquake-resistant ductility, beautiful appearance, the space refers to its structural span not less than 50 meters.

Compared with the shortcomings of the prior art, the invention provides a space curved reticulated shell structure formed by stacking and combining rhombic dodecahedrons, which is a new type of space structure, the invention has the advantages of repeated array effect, fewer connecting rods of nodes, fewer rod specifications, large earthquake-resistant ductility, beautiful appearance, etc, it can be applied to the roof and wall structure of large-span curved buildings such as exhibition halls and gymnasiums, and has broad prospects.

What is claimed is:

1. A construction method of a space curved reticulated shell structure formed by stacking and combining rhombic dodecahedrons, comprising a one-way curved reticulated shell structure (18), a positive curvature two-way curved reticulated shell structure (19) or a negative curvature two-way curved reticulated shell structure (20); a rhombic dodecahedron (1) is a polyhedron composed of twelve congruent rhombus; a dodecahedron basic unit (2) is formed by a bidirectional oblique butting of four rhombic dodecahedrons along a plane; an orthogonal array combination body (5) is formed by the dodecahedron basic unit (2) in array replication along three orthogonal directions; an array combined revolution body (6) is generated by rotating the orthogonal array combination body (5) around a space rotation axis (7) by a certain angle; boundary cutting structures are generated by a plane boundary in span direction (8) or a curved boundary in span direction (9) cutting the array combined revolution body (6), comprising a shell structure in a non-curved state (11) and a curved boundary cutting structure (12); a curved reticulated shell structure is generated by an arched and curved surface of the shell structure in the non-curved state (11), the shell structure in the non-curved state (11) respectively generates a one-way curved reticulated shell structure (18), a positive curvature two-way curved reticulated shell structure (19) or a negative curvature two-way curved reticulated shell structure (20) respectively through one-way bending arching, positive curvature two-way bending arching and negative curvature two-way bending arching;

the method comprising the following steps:

S1. four rhombic dodecahedrons (1) are butted along a first plane oblique intersecting direction (3) and a second plane oblique intersecting direction (4) of a plane bidirectional oblique intersecting to form the dodecahedron basic unit (2);

S2. the orthogonal array combination body (5) is formed by the dodecahedron basic unit (2) in array replication along three orthogonal directions;

S3. the array combined revolution body (6) is generated by rotating the orthogonal array combination body (5) around the space rotation axis (7) by a certain angle;

S4. according to a building boundary cutting form, setting the plane boundary in span direction (8), the curved boundary in span direction (9) and the plane boundary in thickness direction (10);

S5. a plane boundary cutting structure (11) and the curved boundary cutting structure (12) are generated by the plane boundary in span direction (8) or the curved boundary in span direction (9) cutting the array combined revolution body (6); the cutting methods of the plane boundary in span direction (8) or the curved boundary in span direction (9) include a three-dimensional model cutting method and a coordinate positioning cutting method;

S6. on the basis of the plane boundary cutting structure (11) generated in step S5, curved reticulated shell structures are generated by controlling an arching and curved surface method, that is, the plane boundary cutting structure (11) adopts one-way bending arching, positive curvature two-way bending arching or negative curvature two-way bending arching to generate curved reticulated shell structures, the curved surfaces are bent and positioned through corresponding curved surface control lines of one-way bending arching (15), curved surface control lines of positive curvature two-way bending arching (16) and curved surface control lines of negative curvature two-way bending arching (17), so as to generate the corresponding one-way curved reticulated shell structure (18), the positive curvature two-way curved reticulated shell structure (19) and the negative curvature two-way curved reticulated shell structure (20); wherein bending methods of one-way bending arching, positive curvature two-way bending arching and negative curvature two-way bending arching include three-dimensional model bending method and coordinate positioning bending method;

S7. generated curved reticulated shell structures are composed of structural edges of a cutting surface (13) and surface edges of an original rhombic dodecahedron (14) and the inner edges of the original rhombic dodecahedron (23), which are a spatial beam system structure; members include surface chord members (21) and inner web members (22), and nodes include include internal nodes (24) connected between internal web members (22) and surface nodes (25) connected between surface chord members (21).

2. A construction method of the space curved reticulated shell structure formed by stacking and combining rhombic dodecahedrons of claim 1, in step S5, implementation steps of the three-dimensional model cutting method: first, establishing a 3D solid element model in a CAD software, that is, an array combined revolution body composed of solid rhombic dodecahedrons; and then establishing a plane domain boundary and a curved domain boundary generated by the plane boundary in span direction and the curved boundary in span direction; switching to a side view, providing a plane cutting of the 3D solid element model through a Solid Split Operation of the plane domain boundary, and providing a cylindrical and spherical cutting of a 3D solid element model through a Boolean Subtraction Operation of a cylindrical domain boundary and a spherical domain boundary; providing a hyperboloid cutting through hyperboloid domain cutting in Rhino software.

3. A construction method of the space curved reticulated shell structure formed by stacking and combining rhombic dodecahedrons of claim 1, in step S5, implementation steps of the coordinate positioning cutting method: first, digitizing a node coordinates of an array combined revolution body, and importing an input node data file of MATLAB, and then setting the plane boundary in span direction and the curved boundary in span direction of a numerical positioning; writing a corresponding cutting programs respectively to generate the plane boundary cutting structure and curved boundary cutting structure; a control method of the cutting programs is that nodes and members within a cutting range are retained, the nodes and members outside the cutting range are deleted, and nodes are generated at an intersection of a cutting planes, and finally the nearest adjacent nodes on the cutting planes are connected to generate the structural edges of a cutting surface.

4. A construction method of the space curved reticulated shell structure formed by stacking and combining rhombic dodecahedrons of claim 1, in step S6, implementation steps of the three-dimensional model bending method: first, establishing a 3D solid element model in the CAD software, that is, an array combined revolution body composed of solid rhombic dodecahedrons; and then establishing the plane domain boundary generated by the plane boundary in span direction; switching to a top view, providing the plane cutting of the 3D solid element model through the Solid Split Operation of the plane domain boundary to obtain the plane boundary cutting structure, which is a plane frame rigid structure; then, exploding a solid to generate a Wireframe structure, and importing Wireframe structure into Rhino software; positioning the curved surface control lines of one-way bending arching, the curved surface control lines of positive curvature two-way bending arching and the curved surface control lines of negative curvature two-way bending arching through a bending function in Rhino software, so as to providing one-way bending arching, positive curvature two-way bending arching or negative curvature two-way bending arching to generate the curved reticulated shell structures.

5. A construction method of the space curved reticulated shell structure formed by stacking and combining rhombic dodecahedrons of claim 1, in step S6, implementation steps of the coordinate positioning bending method: first, digitizing the node coordinates of the array combined revolution body, and importing the input node data file of MATLAB, and then deducing a node coordinate conversion formulas corresponding to one-way bending, positive curvature two-way bending or negative curvature two-way bending and digitizing node coordinate conversion formulas; writing corresponding bending conversion programs respectively to generate the one-way curved reticulated shell structure, the positive curvature two-way curved reticulated shell structure and the negative curvature two-way curved reticulated shell structure.

* * * * *